US008752245B2

(12) United States Patent
Duffy

(10) Patent No.: US 8,752,245 B2
(45) Date of Patent: Jun. 17, 2014

(54) FINGER-SAFE DOOR

(76) Inventor: Niall J. Duffy, McLean, VA (US)

( * ) Notice: Subject to any disclaimer, the term of this patent is extended or adjusted under 35 U.S.C. 154(b) by 557 days.

(21) Appl. No.: 12/913,750

(22) Filed: Oct. 27, 2010

(65) Prior Publication Data

US 2011/0094057 A1 Apr. 28, 2011

Related U.S. Application Data

(60) Provisional application No. 61/255,477, filed on Oct. 27, 2009.

(51) Int. Cl.
*E05D 11/00* (2006.01)

(52) U.S. Cl.
USPC ..... 16/223; 16/250; 16/251

(58) Field of Classification Search
USPC ..... 411/223, 235, 239, 247, 250, 251, 260, 411/314, 374, 387, DIG. 43; 29/11
See application file for complete search history.

(56) References Cited

U.S. PATENT DOCUMENTS

| | | | | | |
|---|---|---|---|---|---|
| 474,633 | A | | 5/1892 | Glazier | |
| 975,760 | A | | 11/1910 | Freyberg | |
| 1,044,225 | A | | 11/1912 | Molin | |
| 1,117,230 | A | | 11/1914 | Page | |
| 1,258,856 | A | | 3/1918 | Beaudette | |
| 1,415,493 | A | | 5/1922 | Strayer | |
| 1,444,994 | A | | 2/1923 | White | |
| 1,459,238 | A | | 6/1923 | Naslin | |
| 1,504,687 | A | | 8/1924 | Griffin | |
| 1,704,411 | A | | 3/1929 | Steffen | |
| 2,284,320 | A | * | 5/1942 | Howe | 16/250 |
| 2,331,340 | A | | 10/1943 | Mosher | |
| 2,557,716 | A | * | 6/1951 | Allee | 16/250 |
| 2,681,479 | A | | 6/1954 | Dixon | |
| 2,681,480 | A | * | 6/1954 | Dixon, Sr. | 49/383 |
| 2,686,942 | A | | 8/1954 | Spector | |
| 2,694,234 | A | * | 11/1954 | Roby et al. | 49/383 |
| 2,910,741 | A | * | 11/1959 | Dettman | 49/383 |
| 2,995,785 | A | * | 8/1961 | Hallenbeck | 49/383 |
| 3,319,697 | A | * | 5/1967 | Krohn | 160/229.1 |
| 3,591,247 | A | * | 7/1971 | Berry et al. | 312/304 |
| 3,710,415 | A | * | 1/1973 | Wilson | 16/382 |
| 3,827,183 | A | | 8/1974 | Zimmerman et al. | |
| 4,040,142 | A | * | 8/1977 | Ippolito | 16/251 |
| 4,261,140 | A | | 4/1981 | McLean | |
| 4,344,253 | A | * | 8/1982 | Stiles | 49/383 |
| 4,878,267 | A | | 11/1989 | Roach et al. | |
| 5,220,708 | A | * | 6/1993 | Lucas et al. | 16/225 |
| 5,419,084 | A | * | 5/1995 | Sankey et al. | 49/383 |
| 6,353,966 | B1 | * | 3/2002 | King | 16/235 |
| 6,497,073 | B2 | * | 12/2002 | Webb | 49/383 |
| 2005/0150613 | A1 | | 7/2005 | Bennett et al. | |
| 2006/0059662 | A1 | * | 3/2006 | Roeper | 16/382 |

FOREIGN PATENT DOCUMENTS

| | | | |
|---|---|---|---|
| GB | 167605 | A1 | 8/1921 |

* cited by examiner

*Primary Examiner* — Roberta Delisle
(74) *Attorney, Agent, or Firm* — The Johnson IP Law Firm; Rodney D. Johnson

(57) ABSTRACT

A finger-safe door-hinge combination looks and feels like a conventional residential door. Finger protection is achieved through the use of soft, deformable materials on the hinge-side edge in combination with specialized hinges. The deformable materials are shaped to give the appearance of a traditional door yet provide clamping injury protection by yielding to fingers. The specialized hinges provide structural support across the deformable materials in a finger-safe manner such that hinge leaves do not cause clamping injury.

47 Claims, 9 Drawing Sheets

FINGER-SAFE DOOR

RELATED APPLICATIONS

This application claims the benefit of U.S. Provisional Application No. 61/255,477, filed on Oct. 27, 2009, the entire teachings of which are incorporated herein by reference.

BACKGROUND

Residential doors routinely cause severe injury when fingers are clamped between the door and the door jamb. As the door closes, the hinged edge of the door moves towards the door jamb, pinching fingers, sometimes with bone-crushing force. Door clamping injuries are painful and in severe cases, treatment requires finger amputation. Oftentimes, the victims are young children who do not understand the hazards of closing doors.

Clamping injuries can occur anywhere the door meets the door jamb. However, injury is most severe when it occurs on the hinged edge, where leverage from the door frame is greatest. This region, referred to as the "clamping region," generates extreme compressive forces. It has been estimated that a door can produce clamping forces of up to 32,000 lbs. per square inch.

Finger blocking devices are known to be effective in preventing hinge-side clamping injury and are widely used in high risk environments such as daycare centers, nurseries, and homes with small children. However, success in the broader residential market has been limited due to aesthetic considerations. In particular, consumers find the appearance of blocking panels to be unacceptable. In residential applications, the appearance is so objectionable that blocking devices are often removed before the children have outgrown the risk.

Deformable materials have also been employed in certain areas of the door that cause injury. Deformable materials prevent injury by yielding to hands and fingers without crushing them. Yet, devices using deformable materials have never achieved market success due to the lack of a suitable hinge design. Currently, no hinge designs exist that are compatible with popular residential door styles, provide structural support across the deformable edge, and prevent clamping injury within the hinge leaves.

SUMMARY

Embodiments of the invention can include a finger-safe door-hinge combination, that looks and feels like a conventional residential door, suitable for economical manufacture using existing equipment and processes, and can be installed using conventional tools and procedures. Finger protection can be achieved through the use of soft, deformable materials on the hinge-side edge in combination with specialized hinges. The deformable materials can be shaped to give the appearance of a traditional door yet provide clamping injury protection by yielding to fingers. The specialized hinges can provide structural support across the deformable materials in a finger-safe manner such that hinge leaves do not cause clamping injury.

A particular embodiment of the invention can include a finger protective door hinge. The door hinge can include a first hinge leaf pivotably mounted to a second hinge leaf such that the first hinge leaf and the second hinge leaf can be annularly displaced relative to each other from a closed position. A clamping region can exist between the first hinge leaf and the second hinge leaf as the angular displacement approaches the closed position. A shield can be disposed between the first hinge leaf and the second hinge leaf to inhibit access to the clamping region.

More particularly, the door hinge can further include a pocket mounted to the first hinge leaf for slidably receiving the shield. Also, the shield can be fastened to the second hinge leaf.

The first hinge leaf can abut a door edge displaced from the first hinge leaf when in the closed position. Furthermore, the first hinge leaf is a corner hinge leaf.

Another particular embodiment of the invention can include an assembly for inhibiting injury at the jamb edge of a door. The assembly can include a deformable channel mountable to an edge of a door, and a hinge having a door leaf securable to an edge of the door through the deformable channel.

More particularly, the deformable channel can be hollow. The deformable channel can include an elastomeric material. Furthermore, the deformable channel can include a cladding layer over the elastomeric material. The door leaf can be a corner leaf.

Even more particularly, the hinge can further include a jamb leaf, a clamping region, and a shield. The jamb leaf can be pivotably mounted to the door leaf such that the leaves can be annularly displaced relative to each other from a closed position. The clamping region can be between the door leaf and the jamb leaf as the angular displacement approaches the closed position. The shield can be between the door leaf and the jamb leaf to inhibit access to the clamping region.

Yet more particularly, a pocket can be mounted to the door leaf for slidably receiving the shield. The shield can be fastened to the jamb leaf. The door leaf can abut the door edge displaced from the jamb leaf by the deformable channel when in the closed position.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A protective door in accordance with particular embodiments of the invention can be constructed using the same equipment and processes that are used to manufacture conventional doors. In fact, much of the protective door can be identical to existing-door construction. The modifications that provide finger safety are particularly present in the region along the hinge-side edge of the door. The modifications, which include the use of deformable materials and specialized hinges, are internal to the door outer-mold line, and can be implemented in any popular residential door style.

A simple way to visualize the invention is to start with a standard residential door and make a cut from top to bottom that is perpendicular to the front face, about 8 cm in from the hinge side edge. Discard the 8-cm section of door and replace it with a deformable piece, having the same size, shape and finish as the removed-section. The deformable piece has openings to receive specialized hinges that pass through the deformable piece to mount directly to the cut face of the door. The latch-side edge of the door fits the door frame and latch in the same manner as a conventional door. The resulting door has the same form and shape as the original door, but is finger-safe because the hinge-side edge is made of deformable materials and because the hinge leaves do not come together when the door is closed.

Several alternative embodiments of specialized hinges are taught. For many door styles, the various hinge embodiments are functionally interchangeable. However, certain door styles necessitate the use of particular hinge embodiments. In particular, if the door style uses a hinge in which the hinge pin has a large offset from the inside face of the door, a more complex hinge may be needed.

The present invention can be manufactured and marketed as either a pre-hung door or as a replacement door for mounting to an existing jamb. Both embodiments use the same deformable edges and the same specialized hinges, but the pre-hung door also includes a split jamb structure that is not included with the replacement door.

Two alternative embodiments of door deformable edges are taught, each having a different method for hinge installation. In either embodiment, soft, deformable materials are substituted for the rigid materials in the parts of the door that can create clamping injury, referred to as the "clamping region". A first deformable edge is constructed from compressible, resilient, elastomer-foam materials. A second deformable edge is hollow, being formed from a flexible, resilient cladding membrane that creates a void within.

Figure 1:
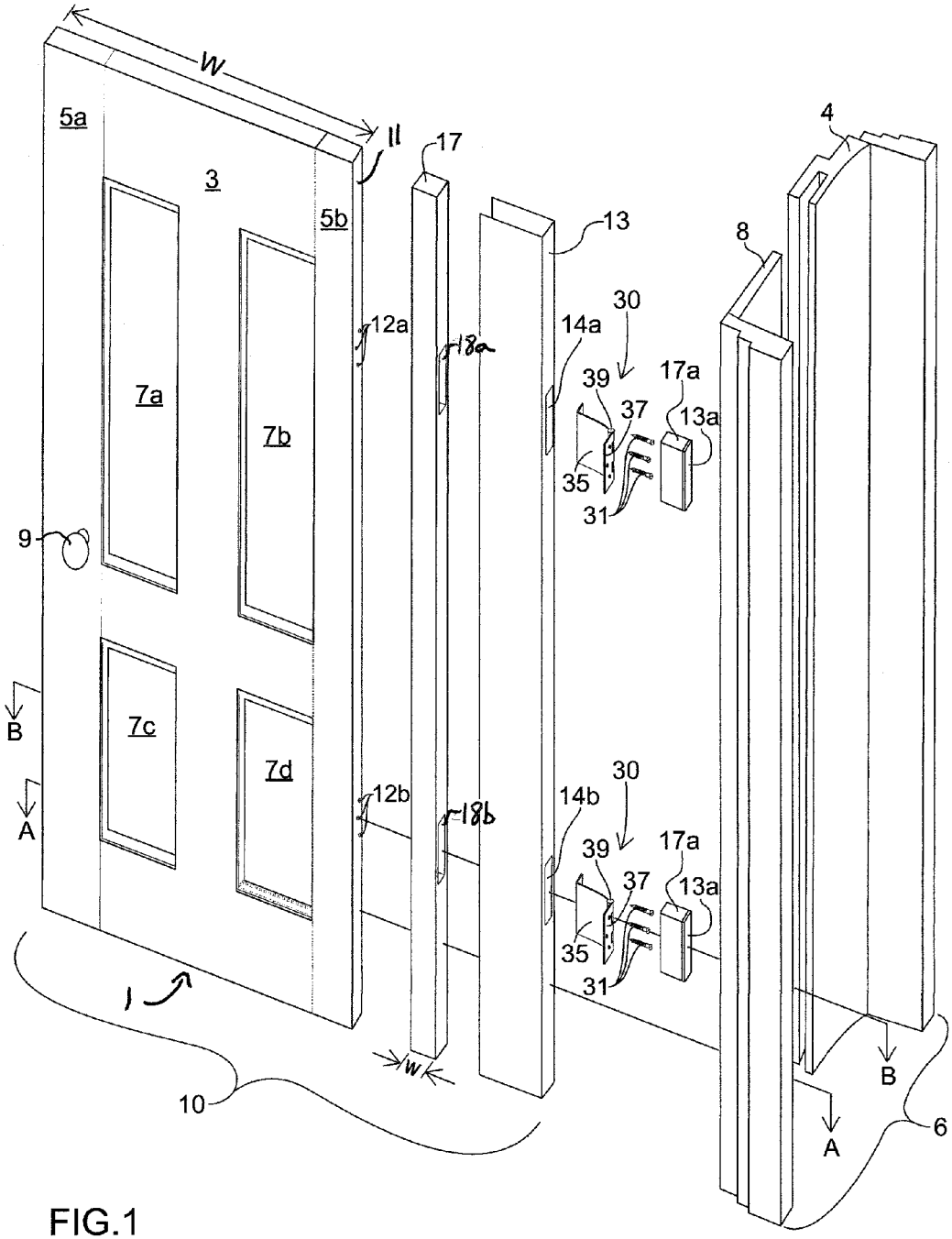
FIG. 1 is an exploded perspective view of a deformable finger-protective door in accordance with a particular embodiment of the invention.

FIG. 1 is an exploded perspective view of a deformable finger-protective door in accordance with a particular embodiment of the invention. The deformable door 10 is depicted as it would appear when viewed from inside a room. The deformable door 10 generally includes a door panel 1, a longitudinal deformable piece 17, and a cladding 13, 13*a*. Also shown is an exemplary door jamb comprising a split jamb 4, a main jamb 8.

The door panel 1 is similar or identical to existing door structures in that it is a millwork assembly of stiles, rails and panels. As shown, the door panel 1 comprises a main body 3 defining lights 7*a*, 7*b*, 7*c*, 7*d*, a latch-side stile 5*a*, and a jamb-side stile 5*b*. The door panel 1 is constructed using any of the existing processes and materials. As examples, the door panel 1 can be thermoformed from medium density fiberboard or it can be assembled from wood, medium density fiberboard, or rigid thermoformed plastic structures. The door panel 1 also includes latch hardware, door knobs 9, and locks, as known in the art.

Compared with a conventional door, the door panel 1 has a width W from the far door edge to an edge 11 that is about 8 cm narrower than the opening in the door frame. To that end, the panel 15 can be formed by longitudinally cutting the jamb-edge stile 5*b* perpendicular to the door face to yield the edge 11. Alternatively, the door can be pre-manufactured to the specified dimensions.

The deformable piece 17 is joined to the jamb-side stile 5*b* at the edge 11 using an adhesive or another suitable method. The deformable piece 17 has the same height and thickness as the panel 15. The width w of the deformable piece 17, about 8 cm, is sized such that the door assembly has outer dimensions that fit the door frame opening. The deformable piece 17 is made of a compressible, resilient, elastomer foam material. Suitable materials include foams of polyamide, polyurea epoxy, rubber (both natural and synthetic), viscose, polyvinyl alcohol, silicone, but the preferred material is open-cell polyurethane foam, also known as urethane foam. Many types of urethane foams are suitable, but high-resilience foams of polyether have been found to be particularly applicable.

The stiffness of the deformable materials is described by the elastic modulus. This is the force per unit area needed to compress the material a certain percentage. The foam of the deformable piece 17 has an elastic modulus that is sufficient to support a rapid, complete recovery of the deformable piece after compression. However, the elastic modulus should not be so great that compression on a hand caught in the clamping region will cause injury. Suitable elastic moduli are typically in the range between 0.001 to 0.1 MPa to provide 25% compression, depending on the width and thickness of the deformable piece 17.

Because the finger of a small child may have a diameter as little as a few millimeters, a channel width of 1 cm could provide some protection for small children. However, to extend protection to larger parts of the hand, and to adult hands, a channel width of at least 3 cm is recommended. Further, for reasons relating to clamping forces and deformable material properties, it may be advantageous to use channel widths that are substantially greater than 3 cm, since larger channels enable the use of stiffer deformable materials.

The present description specifies a channel width of 8 cm, however, a design trade exists between the channel width and the stiffness of the deformable material. Designers should ensure that compressive forces never exceed the level causing injury. Clamping force is proportional to modulus of elasticity of the deformable material and the compressive strain. Compressive strain is proportional to the displacement, (caused by the inserted hand), divided by the total width of the uncompressed deformable material, i.e. the width of the channel. For this reason, hinge designers can reduce clamping force by increasing the width of the hinge channel and the deformable material contained therein. Further, designers can use stiffer deformable materials if channel width is increased.

The deformable piece 17 can be manufactured in a number of different ways including cut from slabstock foam, molded or poured-in-place. For cut or molded manufacturing methods, the deformable piece 17 is secured to the joint edge 11 using a suitable adhesive such as a polyurethane adhesive. If pour-in-place manufacturing is used, adhesive may not be required, depending on the inherent adhesive qualities of the materials used.

The assembly of the deformable piece 17 and jamb-side stile 5*b* is covered with a cladding 13 to give a uniform finish.

The cladding 13 is a thin sheet of flexible polymeric film, such as vinyl, polyethylene, or other similar material. The cladding material can be selected to provide a maintenance-free finish or to be paintable. The cladding 13 is secured to the assembly using any suitable method such as adhesives or thermal bonding. Depending on the materials used and the stylistic needs for uniformity in color and texture, cladding may be needed for only a portion of the door or it may be entirely absent.

A set of deformable-stile-piece cavities 18*a*, 18*b* are provided through the deformable piece 17. They are rectangular cavities extending laterally, parallel to the door face, passing from the hinge side edge completely through to expose the side edge 11 of the door panel 1. A corresponding set of rectangular openings 14*a*, 14*b* are provided in the cladding 13 that are congruent with and align with the cavities 18*a*, 18*b*. The openings 14 and cavities 18 are positioned at hinge-mount locations with sizes and shapes sufficient to receive a channel hinge 30, so named because when the door is closed, the hinge leaves 35, 37 remain separated to form a finger-safe channel that can be filled with deformable materials.

The hinge 30 includes a jamb leaf 37 that mounts to the door jamb and a corner leaf 35 that passes through cavity 18 to mount to the side-edge 11 of the door panel 1, where it is secured by screws 31 into jamb pilot holes 12*a*, 12*b*, or other suitable fasteners. The corner leaf 35 is so named because the leaf has about a 90 degree bend that forms a "corner" within the finger safe channel. The jamb leaf 37 and corner leaf 35 are hingedly coupled using a pin 39 as known in the art.

While the corner leaf is described as being secured to the side-edge of the rigid panel, embodiments are also anticipated in which elements of the corner leaf 35 are integrally manufactured into the rigid panel 1. For example, the rigid panel 1 can have rigid flat-plate extensions, exiting the hinge-side edge, substantially parallel to the door face, in which much of each flat plat extension is internal to the deformable edge. The flat-plate extensions then terminate with knuckles that are external to the deformable edge, for hingedly coupling to butt-hinge leaves that attach to the jamb.

Furthermore, while the deformable edge is shown as extending from the top of the door to the bottom, other embodiments may be useful in which only a portion of hinge-side edge is deformable. For example, the upper half of the door could use a conventional, rigid, hinge-side edge mounted with conventional butt-hinges while the lower half could use a deformable edge mounted with channel hinges. Such a door would be useful since it provides protection for the clamping region within reach of small children.

As should be appreciated, the door of the present invention is used in the same manner as a conventional door. The parts of the door that are normally handled, the latch side edge, the latch-side jamb, and the door handle are made of conventional materials, giving the door the look and feel of a conventional door. The difference appears when a hand or finger is inadvertently caught in the clamping region. Rather than pinching the hand or finger when the door is closed, the deformable materials of the present invention yield harmlessly to reduce or prevent injury.

Figure 2A:
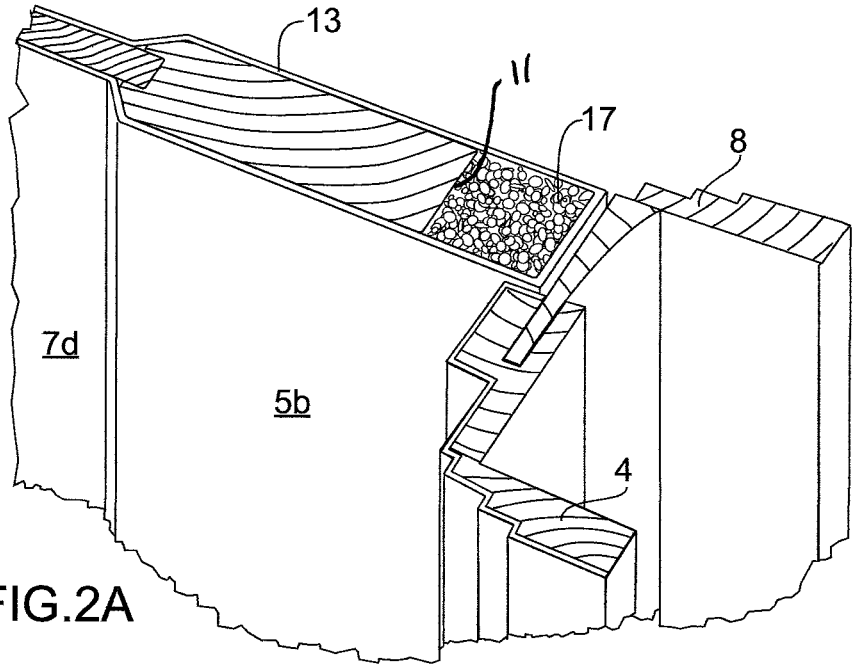
FIGS. 2A-2B are foreshortened lateral cross-sectional views of the deformable door taken along line A-A of FIG. 1.
Figure 2B:
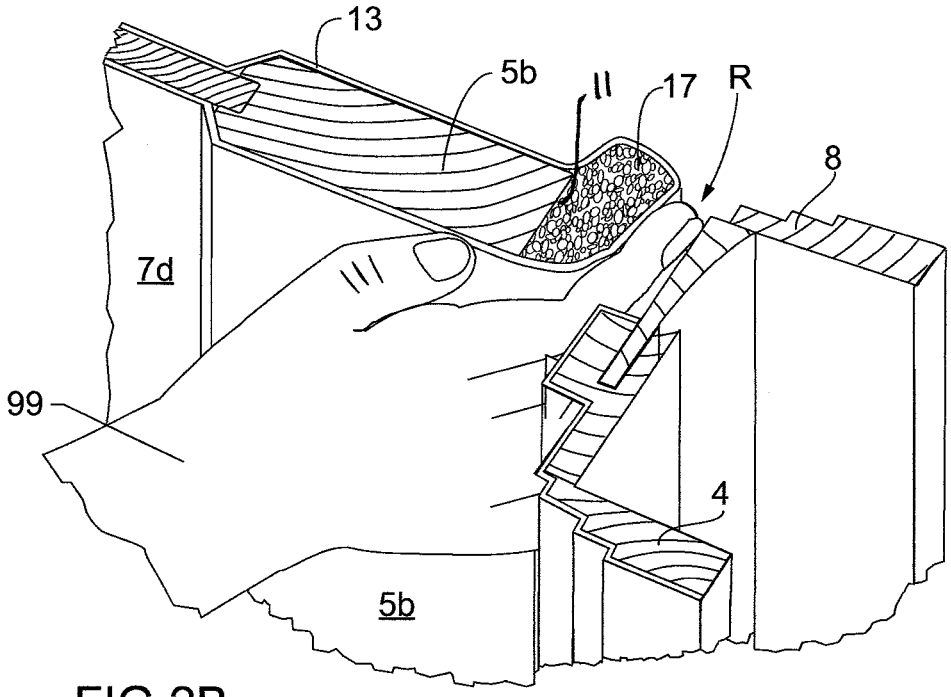

FIGS. 2A-2B are foreshortened lateral cross-sectional views of the deformable door taken along line A-A of FIG. 1. The figures illustrate how the deformable edge functions when a hand is placed in a clamping region R. As shown, FIG. 2A shows the lateral sectional view of the door 10 and FIG. 2B shows the same enlargement of the lateral view, but with a hand 99 caught in the clamping region. Like a conventional door, when the deformable door 10 is closed, the jamb-side edge moves towards the jamb 6. However, the present invention prevents injury because the deformable door edge 17 deforms about the hand 99, applying only a harmless, predetermined compressive force.

Another difference between the illustrated door 10 and a conventional door is in the hinge design. When a conventional door is closed, the hinge leaves come together, crushing fingers caught between. In contrast, the leaves of the channel hinge remain separated when the door closes, creating a finger safe channel that can be filled with deformable materials.

Figure 3A:
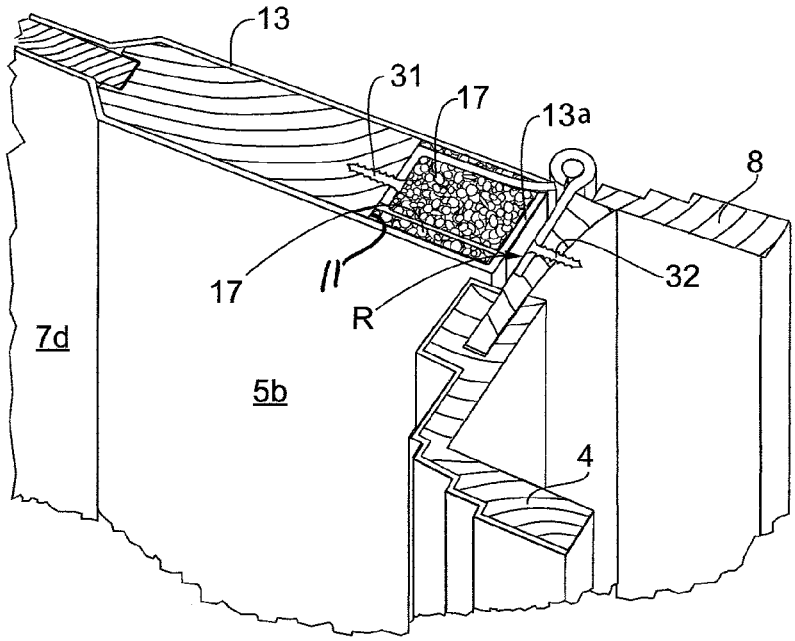
FIGS. 3A-3B are foreshortened lateral cross-sectional views of the deformable door taken along line B-B of FIG. 1.
Figure 3B:
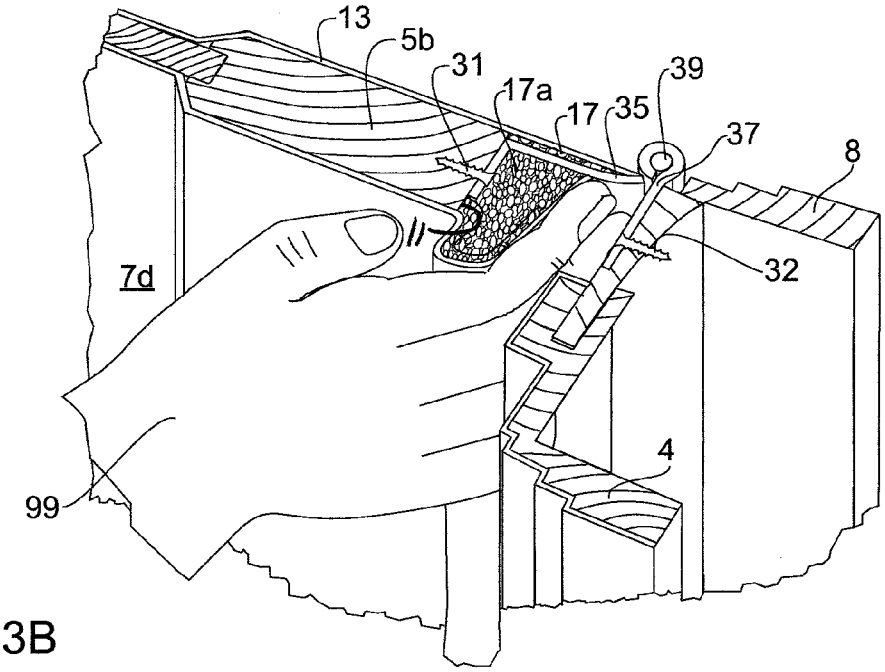

FIGS. 3A-3B are foreshortened lateral cross-sectional views of the deformable door taken along line B-B of FIG. 1. The figures show how fingers are protected when inserted in the clamping region R of the hinge. FIG. 3A shows an enlargement of the lateral-sectional view and FIG. 3B shows the same enlargement of the lateral view, but with a hand 99 caught in the clamping region R, in the vicinity of the hinge. When the door is closed, the rigid hinge structure forms a channel that never encroaches on inserted fingers. Deformable piece 17 and plug 17*a* yield harmlessly to fingers caught in the hinge channel.

It should be noted that the jamb leaf 37 is secured to the jamb by screws 32 and the corner leaf 35 has a curved arm extending from the pin 39. That curvature reduces the chance of a finger being clamped between the hinge leaves. A tapered section of the deformable material remains between the corner leaf 35 and the cladding 13. Embodiments of the invention, however, can be practiced without the curved arm.

The present invention is suitable for use as a replacement door that mounts to an existing jamb or it can be used as a part of a pre-hung door. In either case, the same procedure is used to mount the door to the jamb. Like a conventional pre-hung door, the hinges of the present invention can be removed and reinstalled, using only a screwdriver.

Figure 4:
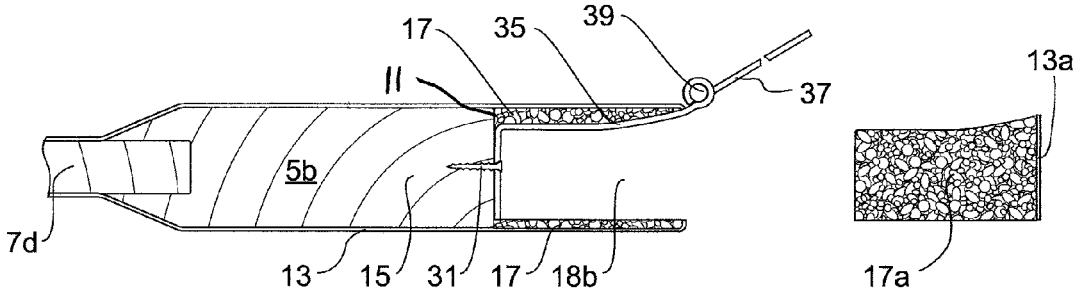
FIG. 4 is a foreshortened lateral, cross-sectional view illustrating how the hinge of FIGS. 3A-3B is mounted to the deformable door.

FIG. 4 is a foreshortened lateral, cross-sectional view illustrating how the hinge of FIGS. 3A-3B is mounted to the deformable door. As shown, the corner leaf 35 is positioned inside a cavity 18*b* of the deformable piece 17 and secured to the stile 5*b* by screws 31. A portion of the cavity 18*b* remains to receive the plug 17*a*.

While the deformable piece 17 has been shown as comprising a deformable material, a hollow-deformable edge door can be used.

Figure 5:
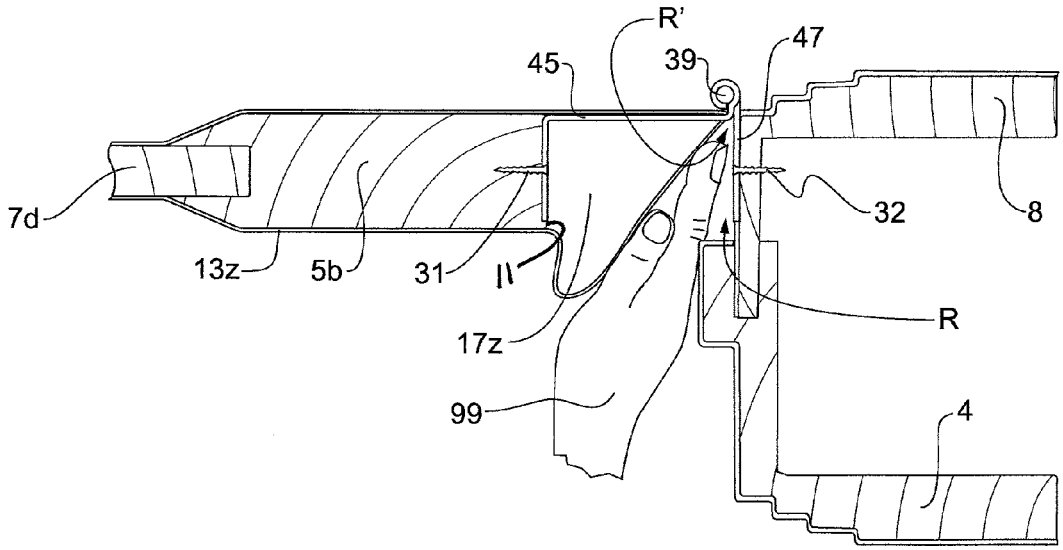
FIG. 5 is a foreshortened lateral-sectional view of the hinge region of a hollow-edge door.

FIG. 5 is a foreshortened lateral-sectional view of the hinge region of a hollow-edge door. A hollow deformable piece 17*z* is formed from a sheet of cladding 13*z*. As shown, the door deforms about a clamped hand 99 to prevent injury. After the door is opened and the hand 99 removed, the hollow piece 17*z* returns to its normal shape.

The hinge 40 includes a jamb leaf 47 and a corner door leaf 45. Unlike the prior corner leaf 35 (FIGS. 3-4) the illustrated leaf 45 is bent or formed into essentially straight sections displaced by 90 degrees. This allows a portion of the corner leaf 45 to abut the cladding 13*z*.

The hollow piece 17*z* is formed by shaping the cladding 13*z* to conform to the door outer-mold line. The cladding 13*z* is a thin sheet of flexible, resilient, polymeric film, such as vinyl, polyethylene, or other similar material. Cladding materials can be selected to provide a maintenance-free finish or to be paintable. The cladding 13*z* is secured to the assembly using any suitable method such as adhesives or thermal bonding.

The cladding 13*z* is shaped to form the hollow piece 17*z* using thermoforming or any other suitable shaping process. The hollow piece 17*z* is flexible but resilient so that it deforms when pressure is applied, but returns to its original shape when pressure is removed. The cladding 13*z* extends past the hollow piece 17*z* to cover portions of door panel 1 as needed to provide a uniform finish and a secure attachment.

It should be noted that the hinge embodiment of FIG. 5 supports door styles in which the hinge leaves 45, 47 extend beyond the door face. The hinge thus has a small additional region R' where the hinge leaves 45, 47 come together to create a clamping hazard. While the residual hazard may be acceptable in many situations, other situations, such as households with small children, may require additional protection. To address such situations, another channel hinge is taught that eliminates the residual risk through the use of a blocking device to prevent finger insertion into the leaf clamping region R'.

Because the deformable edge and the channel hinge have already addressed most of the clamping risk, a blocking device needs to address only the small region R' where the hinge leaves come together, near the hinge pin. To maintain the look and feel of a conventional door, most of the blocking device can be hidden within the deformable edge.

Figure 6:
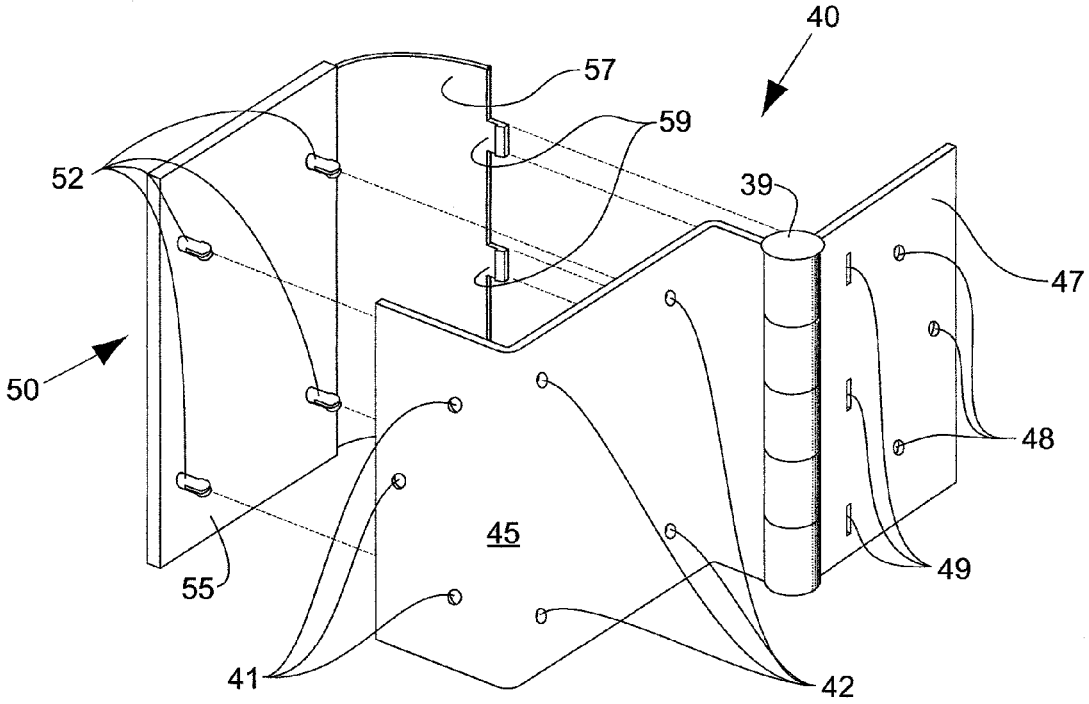
FIG. 6 is a partially exploded perspective view of a particular blocking hinge assembly in accordance with the invention.

FIG. 6 is a partially exploded perspective view of a particular blocking hinge assembly in accordance with the invention. A blocking device 50 includes two parts, namely a finger shield 57 that is slidably retained within a shield housing 55. As shown the blocking device 50 is attached to a corner-type hinge 40, similar to that of FIG. 5.

As shown, the hinge 40 includes a corner leaf 45 pivotably joined with a jamb leaf 47 by a hinge pin 39. The corner leaf 45 includes orifices 41, 42 for receiving screws to attach the corner leaf 45 to a door and the jamb leaf 47 includes orifices 48 for receiving screws to attach the jamb leaf 47 to a door jamb. In addition, the corner leaf 45 includes orifices 43 for receiving fastening pins 52 of the shield housing 55 and the jamb leaf 47 includes slots 49 for receiving tabs 59 of the finger shield 57.

The finger shield 57 is a sheet of flexible polymeric film, such as vinyl, polyethylene, or other similar material. It is sufficiently flexible such that it can bend into a curve as it exits the housing when the door is opened, yet it is sufficiently rigid to block a small child's fingers from insertion into the hinge clamping region. The finger shield 57 terminates with a set of three shield tabs 59. Each tab terminates with a push-in, lock-in-place fastener.

The height of shield 57 exceeds the height of the hinge 40 by a sufficient margin such that a child fingers cannot reach around the shield to get into the clamping region R' when approached from either above or below the hinge.

The width of shield 57 is sufficient to cover the entire hinge clamping region, when the door is fully opened, while about 1 cm of shield remains in the housing 55. When the door is opened, parts of the shield 57 may be visible, depending on the viewing angle. To minimize the visual profile, the shield 57 can be made of a clear, transparent material or a mess. To maintain its shape, the shield 57 can be made from a shape memory material, such as nickel titanium.

The housing 55 is depicted as a flat box with an inner pocket to receive the shield 57 and a set of four attachment tangs 52 which terminate with push-in, lock-in-place fasteners. The housing 55 is made from an easy-to-manufacture material such as plastic. Materials for the shield 57 and the housing 55 have low coefficients of friction to ensure that the shield 57 slides easily into and out of housing 55, preferably without need of a lubricant. To reduce manufacturing expenses, parts of the housing 55 can be eliminated without loss of functionality. The housing need only guide the shield into its internal pocket when the door is closed.

Figure 7:
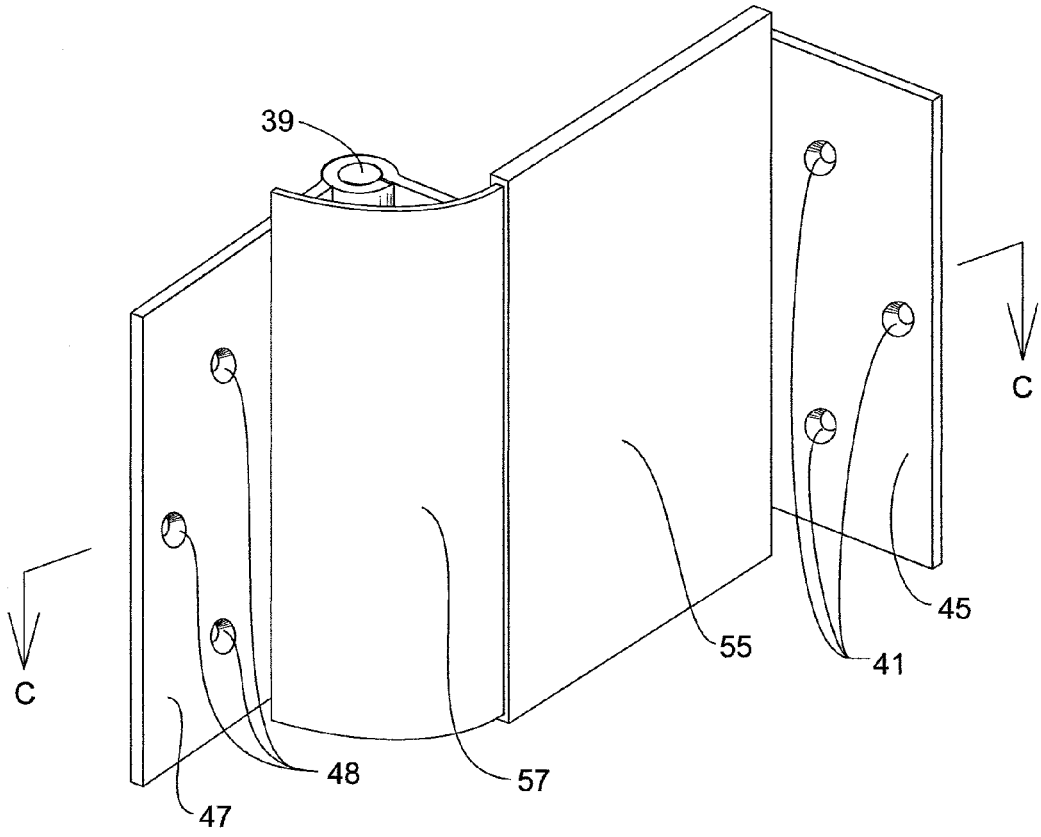
FIG. 7 is a perspective view of the assembled blocking hinge of FIG. 6.

FIG. 7 is a perspective view of the assembled blocking hinge of FIG. 6. As shown, the hinge assembly is shown as it would appear when the door is opened wide. In this position, much of the shield 57 is positioned outside the housing 55 to block finger insertion into the clamping region R'. As the door closes, portions of the shield 57 slide into the housing 55.

Figure 8:
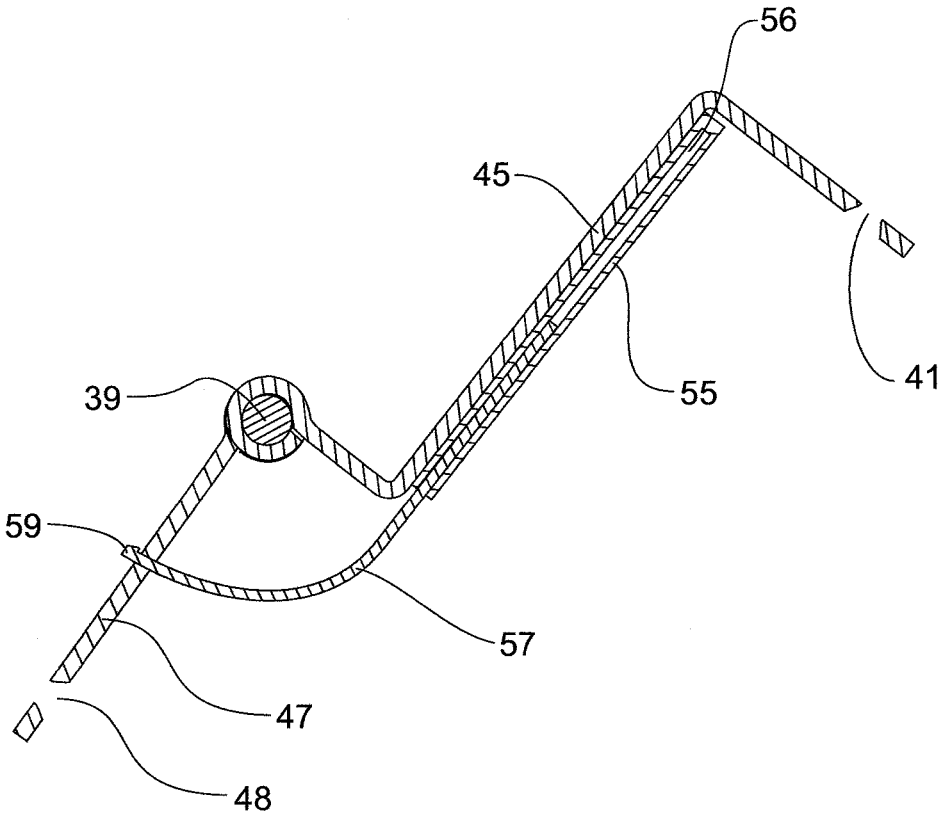
FIG. 8 is a lateral sectional view of the assembled blocking hinge taken along line C-C of FIG. 7.

FIG. 8 is a lateral sectional view of the assembled blocking hinge taken along line C-C of FIG. 7. In particular, the inner pocket 56 of the shield housing 55 is shown.

Figure 9:
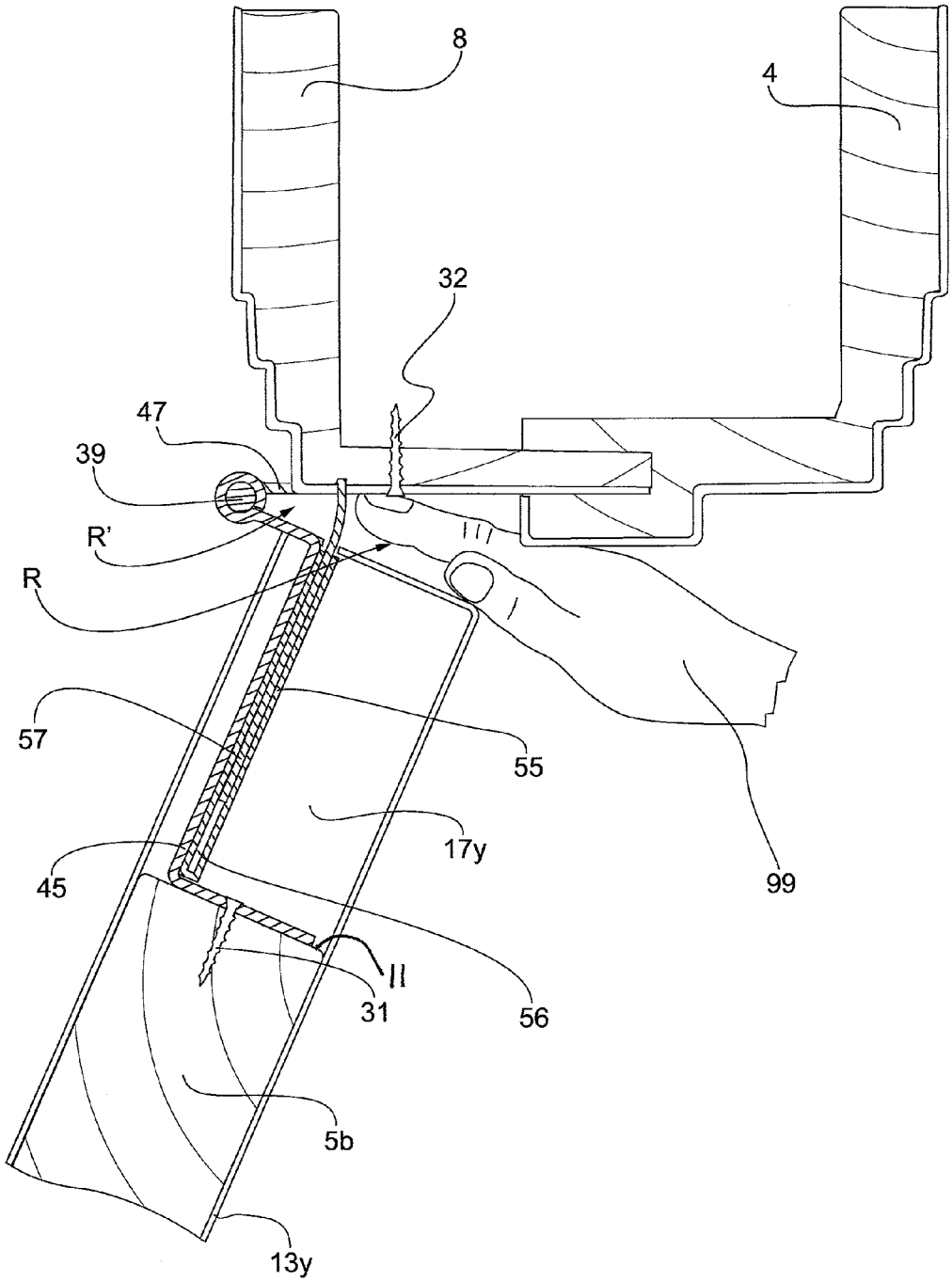
FIG. 9 is a lateral-sectional view of the hinge-side region of the hollow-edge deformable door using blocking hinge assembly of FIGS. 6-8.

FIG. 9 is a lateral-sectional view of the hinge-side region of the hollow-edge deformable door using blocking hinge assembly of FIGS. 6-8. As shown, the door is partially open, with a hand 99 inserted into the deformable clamping region R. The shield 57 prevents fingers from entering into the leaf clamping region R'. Note that the door leaf does not abut the cladding 13*y*, making the leaf clamping region R' larger than in FIG. 5.

The channel for the hinge should be sufficiently wide such that compressive forces applied to hands and fingers inserted into the channel do not cause injury. Additionally, the channel of the hinge should be sufficiently wide such that it can houses a sufficiently wide shield 57, which covers the entire clamping region when the door is fully opened. This width depends on the angle of the fully opened door, and the offset of the hinge. Greater shield width is needed when the door opens to a greater angle or when the hinge-pin offset from the door face is greater.

It should be understood that the pocket housing 55 does not need to be box shaped. Instead, the housing can be cylindrical. Also, a spring can be used to assist the sliding action of the shield 57. The shield 57 can further utilize accordion-type folds to fit the shield 57 into the limited space of the housing 55. Other suitable solutions are available.

It should also be understood that the blocking hinge can be made without the need for the pocket housing 55. Instead, a foam-filled deformable edge can be made with a gap between the deformable material and the leaf 45 for slidably receiving the shield 57. Similarly, for the hollow-deformable edge embodiment, the shield 57 can be received directly into the hollow edge 17*y* without need of housing 55.

Accordingly, it should be apparent that embodiment of the invention can provide the look and feel of a conventional door yet protects against clamping injury. Further, the finger-safe door can be manufactured economically on existing door assembly lines and it can be installed using standard construction tools and procedures.

While this invention has been particularly shown and described with references to particular embodiments, it will be understood by those skilled in the art that various changes in form and details may be made to the embodiments without departing from the scope of the invention encompassed by the appended claims.

For example, while the specification details particular combinations of deformable-edge embodiments with hinge embodiments, this should not be construed as limiting. In fact, each of the various hinge embodiments can be used with either type of deformable edge to provide finger protection with the look and feel of a conventional door.

In addition, while the particular embodiments are described as employing either a hollow deformable edge, or a foam-filled deformable edge, other embodiments are anticipated. For example, the deformable edge could use various combinations of hollow voids together with foam-filled components to protect against injury.

What is claimed is:

1. An assembly for inhibiting injury at the jamb edge of a door, comprising:

a deformable channel mountable to an edge of a door; and a hinge having a door leaf securable to an edge of the door through the deformable channel.

2. The assembly of claim 1 wherein the deformable channel includes a cladding layer.

3. The assembly of claim 1 wherein the deformable channel includes an elastomeric material.

4. The assembly of claim 3 wherein the deformable channel includes a cladding layer over the elastomeric material.

5. The assembly of claim 1 wherein the door leaf is a corner leaf.

6. The assembly of claim 1 wherein the hinge further comprises:

a jamb leaf pivotably mounted to the door leaf such that the leaves can be angularly displaced relative to each other from a closed position;

a clamping region between the door leaf and the jamb leaf as the angular displacement approaches the closed position; and a shield between the door leaf and the jamb leaf to inhibit access to the clamping region.

7. The assembly of claim 6 further comprising a pocket mounted to the door leaf for slidably receiving the shield.

8. The assembly of claim 6 wherein the shield is fastened to the jamb leaf.

9. The assembly of claim 6 wherein the door leaf abuts the door edge displaced from the jamb leaf by the deformable channel when in the closed position.

10. The assembly of claim 1 wherein the deformable channel is at least 1 cm wide.

11. The assembly of claim 10 wherein the deformable channel is at least 3 cm wide.

12. A method of making an assembly for inhibiting injury at the jamb edge of a door, comprising:

mounting a deformable channel to an edge of a door; and securing a hinge having a door leaf to an edge of the door through the deformable channel.

13. The method of claim 12 wherein the deformable channel includes a cladding layer.

14. The method of claim 12 wherein the deformable channel includes an elastomeric material.

15. The method of claim 14 wherein the deformable channel includes a cladding layer over the elastomeric material.

16. The method of claim 12 wherein the door leaf is a corner leaf.

17. The method of claim 12 wherein the hinge comprises:

a jamb leaf pivotably mounted to the door leaf such that the leaves can be angularly displaced relative to each other from a closed position;

a clamping region between the door leaf and the jamb leaf as the angular displacement approaches the closed position; and a shield between the door leaf and the jamb leaf to inhibit access to the clamping region.

18. The method of claim 17 further comprising mounting a pocket to the door leaf for slidably receiving the shield.

19. The method of claim 17 wherein the shield is fastened to the jamb leaf.

20. The method of claim 17 wherein the door leaf abuts the door edge displaced from the jamb leaf by the deformable channel when in the closed position.

21. The method of claim 12 wherein the deformable channel is at least 1 cm wide.

22. The method of claim 21 wherein the deformable channel is at least 3 cm wide.

23. An assembly for inhibiting injury at the jamb edge of a door, comprising:

a deformable channel mountable to an edge of a door, wherein the deformable channel includes a cladding layer over an elastomeric material; and a hinge having a door leaf extendable through the deformable channel and securable to the edge of the door.

24. The assembly of claim 23 wherein the deformable channel is hollow.

25. The assembly of claim 23 wherein the door leaf is a corner leaf.

26. The assembly of claim 23 wherein the hinge further comprises:

a jamb leaf pivotably mounted to the door leaf such that the leaves can be angularly displaced relative to each other from a closed position;

a clamping region between the door leaf and the jamb leaf as the angular displacement approaches the closed position; and a shield between the door leaf and the jamb leaf to inhibit access to the clamping region.

27. The assembly of claim 26 further comprising a pocket mounted to the door leaf for slidably receiving the shield.

28. The assembly of claim 23 wherein the deformable channel is at least 1 cm wide.

29. The assembly of claim 28 wherein the deformable channel is at least 3 cm wide.

30. A method of making an assembly for inhibiting injury at the jamb edge of a door, comprising:

mounting a deformable channel to an edge of a door, wherein the deformable channel includes a cladding layer over an elastomeric material;

extending a hinge having a door leaf through the deformable channel; and securing the door leaf to the edge of the door.

31. The method of claim 30 wherein the deformable channel is hollow.

32. The method of claim 30 wherein the deformable channel includes an elastomeric material.

33. The method of claim 32 wherein the deformable channel includes a cladding layer over the elastomeric material.

34. The method of claim 30 wherein the door leaf is a corner leaf.

35. The method of claim 30 wherein the hinge comprises:

a jamb leaf pivotably mounted to the door leaf such that the leaves can be angularly displaced relative to each other from a closed position;

a clamping region between the door leaf and the jamb leaf as the angular displacement approaches the closed position; and a shield between the door leaf and the jamb leaf to inhibit access to the clamping region.

36. The method of claim 35 further comprising mounting a pocket to the door leaf for slidably receiving the shield.

37. The method of claim 30 wherein the deformable channel is at least 1 cm wide.

38. The method of claim 37 wherein the deformable channel is at least 3 cm wide.

39. A finger-safe door, comprising:

a door having a hinge edge for receiving a hinge leaf;

a deformable channel mountable to the hinge edge of the door; and a hinge having a door leaf extendable through the deformable channel and securable to the hinge edge of the door.

40. The finger-safe door of claim 39 wherein the deformable channel includes a cladding layer.

41. The finger-safe door of claim 39 wherein the deformable channel includes an elastomeric material.

42. The finger-safe door of claim 41 wherein the deformable channel includes a cladding layer over the elastomeric material.

43. The finger-safe door of claim 39 wherein the door leaf is a corner leaf.

44. The finger-safe door of claim 39 wherein the hinge further comprises:

a jamb leaf pivotably mounted to the door leaf such that the leaves can be angularly displaced relative to each other from a closed position;

a clamping region between the door leaf and the jamb leaf as the angular displacement approaches the closed position; and a shield between the door leaf and the jamb leaf to inhibit access to the clamping region.

45. The finger-safe door of claim 44 further comprising a pocket mounted to the door leaf for slidably receiving the shield.

46. The finger-safe door of claim 39 wherein the deformable channel is at least 1 cm wide.

47. The finger-safe door of claim 46 wherein the deformable channel is at least 3 cm wide.

* * * * *